United States Patent [19]

Seidler

[11] 4,366,915

[45] Jan. 4, 1983

[54] HINGED LID CONTAINER

[75] Inventor: David Seidler, Forest Hills, N.Y.

[73] Assignee: Revlon Inc., Tuckahoe, N.Y.

[21] Appl. No.: 187,887

[22] Filed: Sep. 17, 1980

[51] Int. Cl.[3] ..... B65D 43/14; B65D 51/04

[52] U.S. Cl. ..... 220/339; 220/306; 206/1.5

[58] Field of Search ..... 220/334, 339, 306; 206/387, 1.5

[56] References Cited

U.S. PATENT DOCUMENTS 3,904,074 9/1975 Hoffman .

4,314,637 2/1982 Posso ..... 220/339 X

*Primary Examiner*—George T. Hall

*Attorney, Agent, or Firm*—Blum, Kaplan, Friedman, Silberman and Beran

[57] ABSTRACT

A plastic lid having a hinge formed in a planar panel is connected to a container body without use of hardware. An integral lid catch using no hardware, engages in the container body to close the container. Containers comprise two or three pieces.

28 Claims, 13 Drawing Figures

FIG. 1
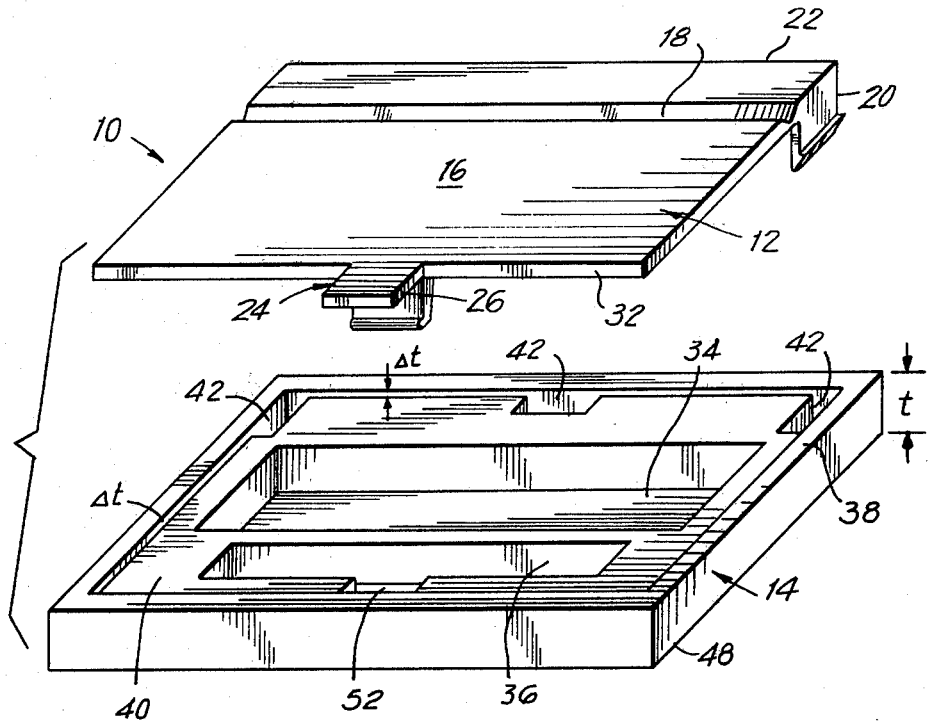
FIG. 2
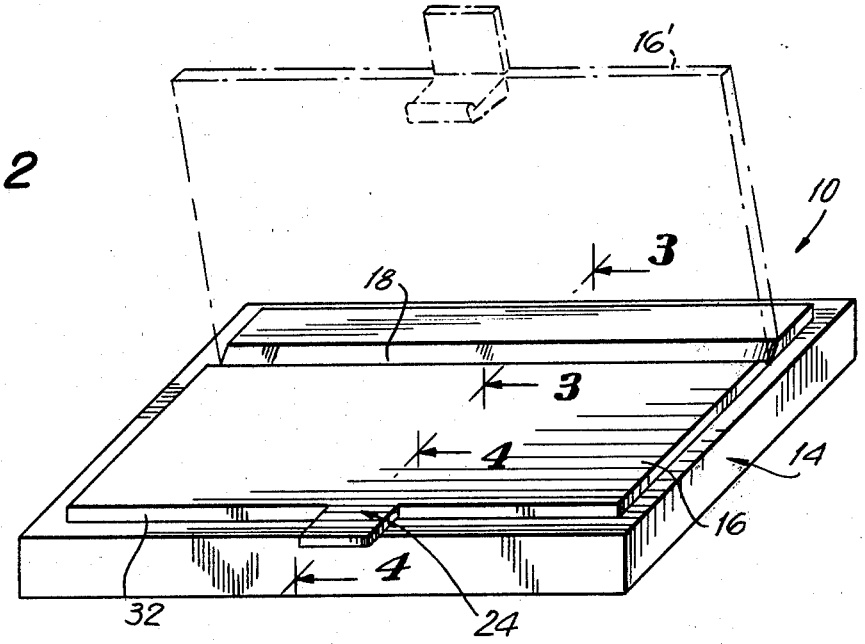
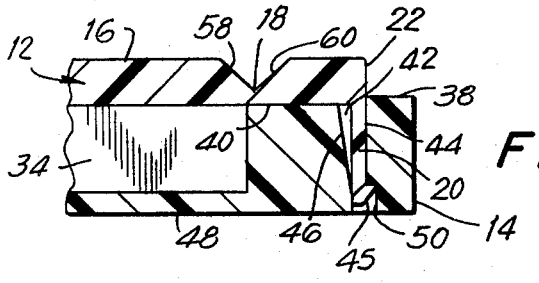
FIG. 3

HINGED LID CONTAINER

BACKGROUND OF THE INVENTION

This invention relates generally to a hinged lid container and more particularly to a hinged lid container wherein the hinge is formed in a planar surface of a plastic lid and connection to a container body is accomplished without use of hardware. Containers, for example, cosmetic compacts, which use pin hinges or snap hinges for the covers are expensive to produce both in tooling and in production. Precise tolerances are generally required which limits the materials for the container, the shape of the finished products and the methods of manufacturing. Materials which do not readily conform to close tolerances, for example, wood, glass and extruded products are costly to use and accordingly by-passed in designing such articles. Pin hinges on lids and snap hinges require time consuming effort for assembly and alignment.

What is needed is a hinged lid container which is inexpensive to produce and assemble and can be made with relatively low precision without marring the appearance or performance of the finished product.

SUMMARY OF THE INVENTION

Generally speaking, in accordance with the invention, a hinged lid container especially suitable for manufacturing to low tolerances and from inexpensive materials is provided. A plastic lid having a hinge formed in a planar panel is connected to a container body without use of hardware. An integral lid catch using no hardware engages the container body to close the container. Recessing the lid into the container body eliminates gaps due to lid warpage. The container including the hinged lid may be of two or three piece construction.

Accordingly, it is an object of this invention to provide an improved hinged lid container having a construction which requires little precision in manufacture but maintains an attractive appearance.

Another object of this invention is to provide an improved hinged lid container having a hinge formed within a planar lid.

A further object of this invention is to provide an improved hinged lid container assembled and operable without the use of hardware.

Still another object of this invention is to provide an improved hinged lid container with a catch having an interference or friction fit with the container body.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is an exploded top perspective view of a hinged lid and container body in accordance with this invention;

FIG. 2 is a top perspective view of the lid and body of FIG. 1 in an assembled condition;

FIG. 3 is a partial sectional view in elevation taken along the line 3—3 of FIG. 2;

DESCRIPTION OF THE PREFERRED EMBODIMENTS

Figure 4:
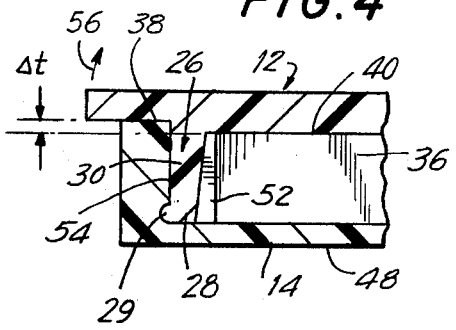
FIG. 4 is a partial sectional view in elevation taken along the line 4—4 of FIG. 2.

With reference to the FIGS. 1–4, a hinged lid container 10 in accordance with this invention includes a hinged lid 12 and container body 14. The hinged lid 12 is comprised of a planar lid 16 having a hinge 18 extending laterally between the sides of the lid 12. Three hooked shaped tabs 20 (two tabs not shown) extend transversely from the planar surface at the sides and center of the rear plate 22 of the planar lid 16. As best seen in FIG. 3, the hook portion at the lower end of the tab 20 is an extension beyond the rear plate 22 of the planar lid 16.

The hinged lid 12 also includes a catch 24 having a tab 26 which is a central extension of the planar lid 16. As best seen in FIG. 4 a snap 28 is a rounded frontwardly extending protrusion 29 on a tapered flange 30 extending downward from the front edge 32 of the lid 16.

The container body 14 is rectilinear in shape and has, for the sake of an example, two interior compartments 34,36 suitable for holding materials, for example, in a small size the compartment 34 may hold cosmetics while the compartment 36 holds a brush applicator for use with the cosmetic product. The body 14 has a rectilinear frame-type border 38 which has a planar upper surface and a height t which represents the full depth of the body 14. A second planar surface 40 is recessed below the frame border 38 by an amount $\Delta t$ as best seen in FIG. 4. Recesses 42 are formed into the second planar surface 40 adjacent to the border 38. Each recess 42 has a perpendicular rear surface 44 and sloping surface 46 such that the recess 42 becomes narrower toward the base 48 of the body 14. The rear wall 44 of the recess 42 has an offset perpendicular surface 50 proximate the base 48 and the portion of the forward recess surface 46 opposing the offset surface 50 is perpendicular to the base 48.

Accordingly, when the hooked shaped tabs 20 of the hinged lid 12 are inserted into the recesses 42, the hooked ends are wedged between the offset surface 50 in the recess and the perpendicular portion at the bottom of the surface 46. Sloping surfaces 45 of the tabs 20 and recesses 42 are in registry, whereby the lid 12, once having its tabs 20 fully inserted in the recesses 42 is not readily removeable.

A recess 52 is provided in the second planar surface 40 adjacent the border 38 at the front of the body 14 to receive therein the snap 28 with the rounded protrusion 29 of the catch tab 26. As seen in FIG. 4, the tab 26 engages only the forward surface 54 of the recess 52 which is contoured to mate with the forward surface of the tab 26. The hinged lid 12 is made of semi-rigid material whereby, when a force is applied in the direction indicated by the arrow 56, the rounded protrusion 29 of the tab 26 readily slides around the contours of the forward surface 54 of the recess 52. Thus, the catch is simply disengaged from the body 14. The broken lines of FIG. 2 indicate the hinged lid container 10 in accordance with this invention in an open condition.

The base 48 of the container body 14 is continuous such that the compartments 34, 36 include bottoms and the two pieces, namely, the hinged lid 12 and container body 14 comprise the entire construction.

The body 14 is fabricated of rigid material, for example, plastic, glass, metal, wood and electroplated materials formed by any of a variety of methods. For example, the body 14 can be formed by injection molding, extrusion, machining, casting and pressing. Relatively inexpensive tooling is needed for production.

The hinged lid 12 is made of plastic which is semi-rigid but is relatively bendable at the hinge 18 which is in the form of a V-groove substantially reducing the thickness of the planar cover 16 at the line of bending. The intersecting surfaces 58,60 of the hinge groove meet at right angles such that the lid can be raised to a substantially perpendicular position relative to the body 14. As stated above, the broken lines of FIG. 2 show the lid in an open condition as indicated with the reference numeral 16'. The hinge 18, known in the art as a living hinge, has a long life under repeated bending. Polypropylene is a material which has given good results in fabricating a lid 12 including a living hinge 18.

It will be apparent that it is not necessary to have a separated surface 40 recessed by a distance Δt from the planar border 38. Further, the planar lid 16 may have rectilinear dimensions similar to the body whereby the border 38 is not visible in a top view. In an alternative embodiment, the tabs 20 can extend along the entire rear plate 22 of the hinged lid 12 and the central recess 42 may be elongated proportionately.

Figure 5:
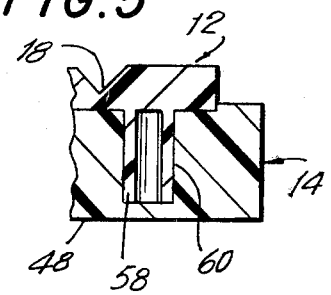
FIG. 5 is a partial sectional view of an alternative embodiment of hinged lid and container body in accordance with this invention.

FIG. 5 shows an alternative attachment for the hinged lid 12 to the body 14. Circular pins 58 integral with the hinged lid 12 extend into mating holes 60 in the container body 14 with a force fit such that the lid 12 is joined to the body 14 and cannot be removed except by the application of a force greater than that usually applied in use of the container. The rounded pins 58 may be solid or hollow; a hollow pin is illustrated in FIG. 5.

In the embodiments of FIGS. 1–4 and FIG. 5, the hinged lid 12 and the container body 14 are each integral components requiring no hardware or sub-assembly, although it should be readily understood, that these parts may also be fabricated from a plurality of components. However, the economy of production is reduced by such manufacturing techniques. The assembled hinged lid container 10 requires no hardware to produce a functioning entity.

Figure 6:
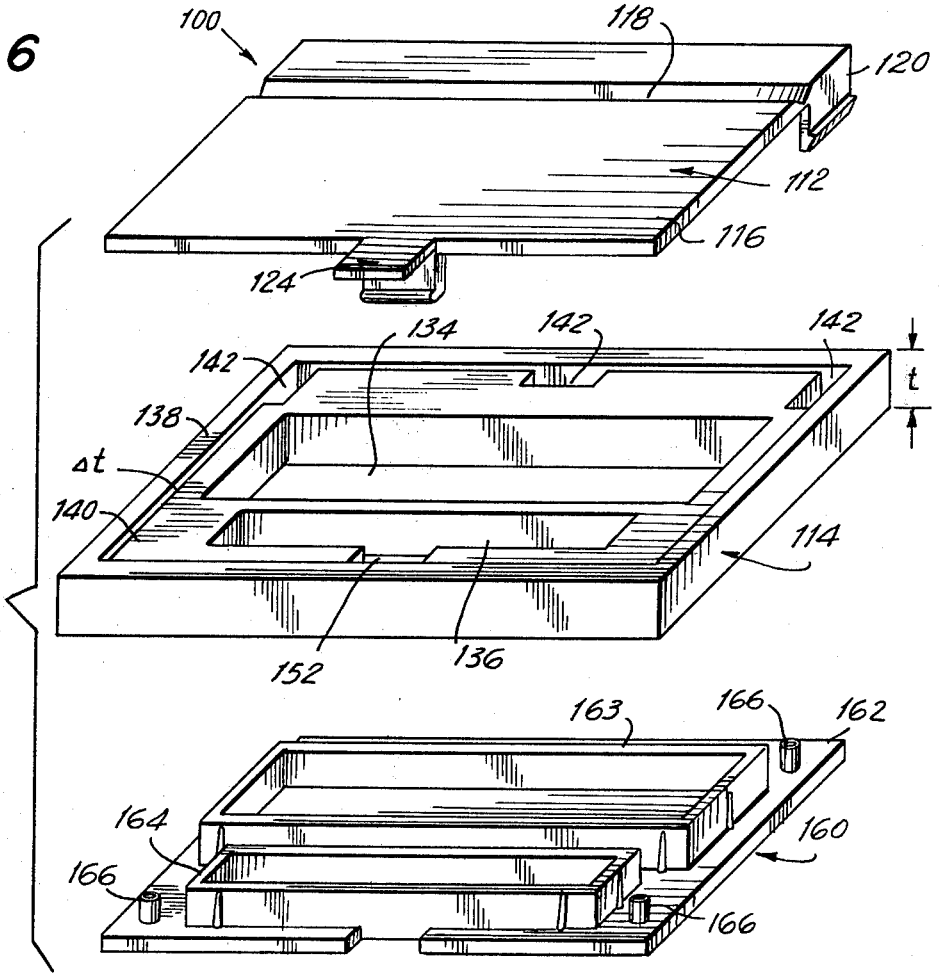
FIG. 6 is a top perspective exploded view of a three-piece container using the hinged lid in accordance with this invention.

FIG. 6 illustrates a three-component hinged lid container 100 in accordance with this invention. In this exemplary embodiment, a hinged lid 112 is similar to the lid 12 of FIG. 1 and includes a living hinge 118 and a plurality of tabs 120 for engagement in body recesses 142. The lid 116 is planar with the hinge 118 cut into the planar upper surface. A catch 124 has the same construction as the catch 24 of FIG. 1 and engages a tab recess 152 in the body 114 as in the previously described embodiments. The container body 114 includes a border 138 and second planar surface 140 recessed by a distance Δt. A pair of interior compartments 134, 136 are provided for receiving the contents of the container therein. However, contrary to the body 14 of FIG. 1, the compartments 134, 136 of the embodiments of FIG. 6 have no closed bottom surfaces.

Figure 7:
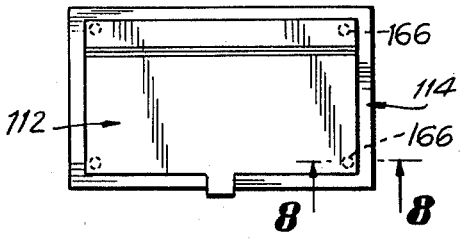
FIG. 7 is top view to a smaller scale of the container of FIG. 6.
Figure 8:
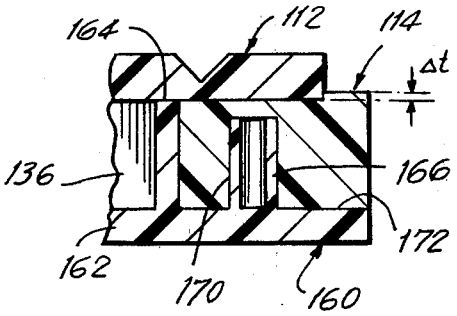
FIG. 8 is partial sectional view in elevation taken along the line 8—8 of FIG. 7.

In a top view (FIG. 7) the containers of FIGS. 1 and 6 appear to be identical. However, a bottom for the compartments 134, 136 is provided by a base 160 which has a generally planar bottom piece 162 and narrow rectilinear frames 163, 164 elevated above the bottom piece 162 and integral therewith. The external dimensions of the frames 163, 164 correspond to the internal dimensions of the compartments 134, 136 respectively. Thus, as described more fully hereinafter, when the container body 114 rests upon the base 160, the frames 163, 164 register with the compartment openings 134, 136 and enter therein. Hollow posts 166 extend from the bottom piece 162 and engage holes 170 in the bottom surface 172 of the container body 114 with a press fit. Thus, a firm integral construction is formed of the two components. As seen in FIGS. 6 and 7, posts 166 are located at the four corners of the base 160. In other respects the embodiment of FIGS. 6–8 are similar to the embodiment of FIGS. 1–5.

Figure 9:
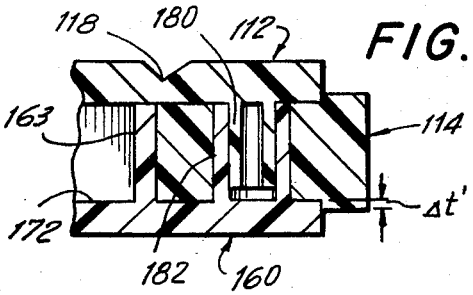
FIG. 9 is partial sectional view in elevation of a connection of container base to container lid in accordance with this invention.

As stated above, the hinged lid engages in the recesses 142 in the container body 114. However, as illustrated in FIG. 9, the hinged lid 112 can be joined to the base 160 rather than to the container body 114. A hollow post 180 on the hinged lid 112 is press fitted into a hollow receiver 182 raised above the bottom surface 172 of the base 160. The container body 114 is sandwiched between the hinged lid 112 and the base 160. Such a construction is especially suitable when the body 114 is fabricated of materials or by methods which result in a low tolerance fit. For example, plastic, glass, metal, wood and electroplated materials may be used, formed by any of a variety of methods such as injection molding, extrusion, machining, casting and pressing. Thus, relatively inexpensive tooling is needed for production of the body 114 having wide dimensional tolerances.

It should be noted in FIG. 9 that an offset Δt' between the base surface 172 and body 114 adjacent to the connection between the lid 112 and base 160 assures proper positioning of the container body 114.

A hooked tab construction as shown in FIG. 3 can also be used in an assembly similar to FIG. 9 wherein the tab 20 on the lid engages in a recess formed in the base 160 similar to the recess 42 of FIG. 3.

Figure 10:
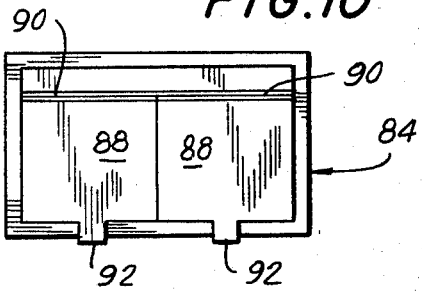
FIGS. 10–13 are top views of multi-lidded containers in accordance with this invention.
Figure 11:
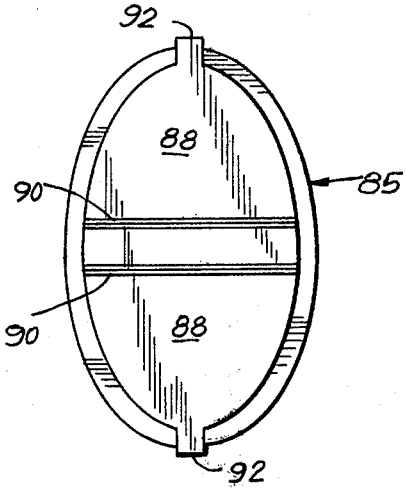
Figure 12:
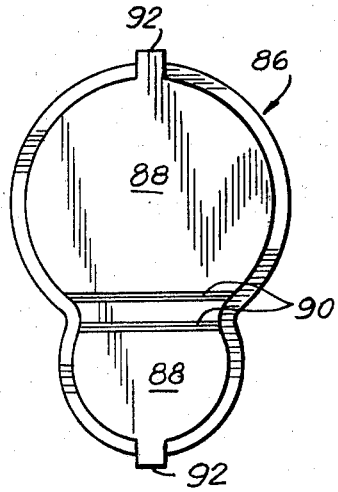
Figure 13:
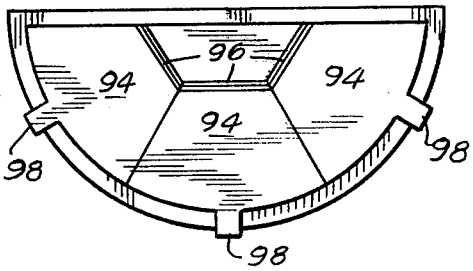

FIGS. 10–13 show hinged lid containers 84, 85, 86 respectively having a plurality of hinged lids 88 including living hinges 90 and catch tabs 92. FIG. 10 illustrates a rectangular arrangement with side-by-side compartments and colinear living hinges 90. FIGS. 11 and 12 illustrate parallel hinges 90 such that the lids open in opposite directions in a back-to-back arrangment of compartments. FIG. 13 illustrates a container having three compartments and three hinged lids 94, each lid having a living hinge 96 and a catch tab 98. The lids are arranged in a fan-shaped pattern. As will be apparent from FIGS. 10–13, the variety of shapes to which the hinge lid in accordance with this invention may be adapted is virtually unlimited. Regardless of shape the attachments between the lids and the bodies or the lids and the bases is as described above.

It should be apparent, that recessing of the surface 40 by a distance Δt in FIG. 1 is not a necessary requirement of all embodiments. The recess Δt does allow for some warpage in the hinged planar lid 16 without marring the appearance of the finished product. Also, with reference to FIG. 6, it is not necessary that the base 160 include the frames 163,164 which nest within the openings of the compartments 134,136 of the body 114. However, in a multi-compartmented container as illustrated, the frames 163,164 prevent cross-flow of stored material between the compartments 134,136. Out leakage at the interface between the container body and base is also prevented.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A hinged lid container comprising:

a lid including a hinge;

a container body, said container body including at least one body surface required to be selectively covered or uncovered;

means for joining said lid to said container body, said joining means including at least one tab extending from a portion of said lid on one side of said hinge, and at least one recess in said container body having offset means for engaging said tab therein, and being adapted to position said lid in registry with said at least one body surface, selective operation of said hinge causing said body surface to be covered or uncovered by said lid.

2. A hinged lid container as claimed in claim 1, wherein said lid includes a planar surface and said hinge extends in a straight hinge line across said at least a portion of said planar surface, said hinge comprising a reduction in thickness of said lid.

3. A hinged lid container as claimed in claim 2, wherein said reduction of thickness is formed inwardly from said planar surface.

4. A hinged lid container as claimed in claim 3, wherein said planar surface of said lid is on the exterior of said joined container.

5. A hinged lid container as claimed in claim 4, wherein said reduction of thickness is a V-shaped indentation.

6. A hinged lid container as claimed in claim 5, wherein said V-shaped indentation forms equal angles with said planar surface whereby said hinge can bend only 90° at said hinge line.

7. A hinged lid container as claimed in claim 6, wherein said at least one body surface has a compartment formed therein.

8. A hinged lid container as claimed in claim 3, 4 or 7, wherein said at least one container body surface is planar and a surface of said lid opposite to said exterior planar lid surface is also planar.

9. A hinged lid container as claimed in claim 8, wherein said opposed planar lid surfaces are parallel.

10. A hinged lid container comprising:

a lid including a hinge;

a container body, said container body including at least one body surface required to be selectively covered or uncovered;

means for joining said lid to said container body including at least a post extending from a portion of said lid on one side of said hinge and at least one socket in said container body, said at least a post engaging said at least one socket with a press fit, whereby a substantially irreversible connection is made between said lid and said body, and being adapted to position said lid in registry with said at least one body surface, selective operation of said hinge causing said body surface to be covered or uncovered by said lid.

11. A hinged lid container as claimed in claim 1, 3, 4, 7 or 10, and further comprising a catch tab integral with said lid on the other side of said hinge line, said catch tab extending from said lid;

and a receiver in said container body, said catch tab entering and being removably engaged in said receiver when said at least one body surface is covered.

12. A hinged lid container as claimed in claim 11, wherein said tab includes a protrusion, said protrusion registering with a recess in said receiver to provide said engagement.

13. A hinged lid container, comprising:

a lid including a hinge;

a container body, said container body including at least one body surface required to be selectively covered or uncovered;

a base, said base positioned on the opposite side of said container body from said lid;

means for joining said lid to said base, said body being sandwiched between said lid and said base, said joining means being adapted to position said lid in registry with said at least one body surface, selective operation of said hinge causing said at least one body surfaces to be covered or uncovered by said lid.

14. A hinged lid container as claimed in claim 13, wherein said lid includes a planar surface and said hinge extends in a straight hinge line across said at least a portion of said planar surface, said hinge comprising a reduction in thickness of said lid.

15. A hinged lid container as claimed in claim 14, wherein said reduction of thickness is formed inwardly from said planar surface.

16. A hinged lid container as claimed in claim 15, wherein said planar surface of said lid is on the exterior of said joined container.

17. A hinged lid container as claimed in claim 16, wherein said reduction of thickness is a V-shaped indentation.

18. A hinged lid container as claimed in claim 17, wherein said V-shaped indentation forms equal angles with said planar surface whereby said hinge can bend 90° at said hinge line.

19. A hinged lid container as claimed in claim 18, wherein said at least one body surface has a compartment formed therein.

20. A hinged lid container as claimed in claims 15, 16 or 19, wherein said means for joining includes at least one hooked tab extending from a portion of said lid on one side of said hinge line, and at least one recess in said base having offset means for engaging said hooked tab therein.

21. A hinged lid container as claimed in claims 15, 16 or 19, wherein said means for joining said lid to said base includes at least one post extending from a portion of said lid on one side of said hinge line and at least one socket in said base, said at least one post engaging said at least one socket with a press fit whereby a substantially irreversible connection is made between said lid and said case.

22. A hinged lid container as claimed in claim 20, and further comprising a catch tab integral with said lid on the other side of said hinge line, said catch tab extending from said lid;

and a receiver in said container body, said catch tab entering and being engaged in said receiver when said at least one body surface is covered.

23. A hinged lid container as claimed in claim 22, wherein said tab includes a protrusion, said protrusion registering with a recess in said receiver to provide said engagement.

24. A hinged lid container as claimed in claim 1, 10 or 18 and further comprising at least one additional lid, said container body including at least one additional body surface required to be selectively covered or uncovered, each said additional lid being positioned for registry with one said additional body surface.

25. A hinged lid container as claimed in claim 21, wherein said body is constructed of a material selected from the group of materials including plastic, glass, metal, wood and electroplated elements with wide dimensional tolerance.

26. A hinged lid container as claimed in claim 23, wherein the fit between said body and said base and lid is of wide dimensional tolerance.

27. A hinged lid container as claimed in claim 1 or 10, wherein the fit between said body and lid is of wide dimensional tolerance.

28. A hinged lid container as claimed in claim 27, wherein said body is constructed of a material selected from a group of materials including plastic, glass, metal, wood and electroplated elements with wide dimensional tolerance.

* * * * *